United States Patent [19]

Ng et al.

[11] Patent Number: 5,077,159

[45] Date of Patent: Dec. 31, 1991

[54] CHARGE INJECTION AMPLIFICATION

[75] Inventors: Yee S. Ng, Fairport; Frederick R. Gilley, Rochester, both of N.Y.

[73] Assignee: Eastman Kodak Company, Rochester, N.Y.

[21] Appl. No.: 463,218

[22] Filed: Jan. 10, 1990

[51] Int. Cl.[5] ..... G03G 13/22

[52] U.S. Cl. ..... 430/54; 430/97; 430/117

[58] Field of Search ..... 430/54, 31, 97, 127, 430/117, 55, 35; 355/219, 245

[56] References Cited

U.S. PATENT DOCUMENTS 4,465,749 8/1984 May et al. ..... 430/54

4,877,699 10/1989 Young et al. ..... 430/54

4,950,569 8/1990 May ..... 430/31

*Primary Examiner*—Marion E. McCamish

*Assistant Examiner*—Rosemary Ashton

*Attorney, Agent, or Firm*—Leonard W. Treash

[57] ABSTRACT

A weak electrostatic image on an imaging member is amplified by first toning it with charge injection toner. The imaging member is treated without fusing the toner image to reduce the charge injection inhibiting effect of charge associated with the toner imaging member interface. Subsequently to or simultaneously with said treating step the imaging member is charged positively, which charge injects through the toner to create an amplified electrostatic image that can be toned.

8 Claims, 4 Drawing Sheets

CHARGE INJECTION AMPLIFICATION

FIELD OF THE INVENTION

This invention relates to electrophotography and more specifically to an improved form of image amplification using charge injection toners.

BACKGROUND ART

U.S. Pat. No. 4,465,749 issued Aug. 14, 1984 to J. W. May and Y. S. Ng, discloses a method of amplifying an electrostatic image using charge injection toners. This patent application is an improvement of that method, and that patent is incorporated by reference herein.

According to U.S. Pat. No. 4,465,749, a weak electrostatic image is formed by exposing a charged photoconductive member, for example, an image formed from exposure to starlight, a radiographic image using very low exposure, or an exposure of an intensity comparable to those in conventional photographic cameras. This weak exposure creates an image having a voltage differential as small as 20 volts between the image areas and the background areas. That image is toned with a charge injection toner creating a weak toner image which would ordinarily not be particularly useful because it is barely visible. The weak toner image is fused to the photoconductor and the photoconductive member is recharged. The charge injection characteristics of the toner cause charge to leak through the toner and the photoconductive member to ground creating a substantially enhanced electrostatic image which can be toned. Amplifications are possible with this approach of 5–30 times with good resolution. Using this method overall system speeds were obtained comparable to that available with ordinary ASA 100 silver halide photographic film.

The amplified toner image can be transferred to a receiving sheet. Additional copies of the same image can be made from the same low density fused image using a form of xeroprinting. However, the imaging member itself is not readily reusable for a new image because of the fused image of charge injection toner. Although processes are known in which masters for xeroprinting are reused by using solvents or scraping action to remove the toned image, such steps greatly restrict the materials usable and are not considered practical.

DISCLOSURE OF THE INVENTION

It is the object of the invention to provide a method of amplifying electrostatic images using charge injection toners in which the toner does not have to be fused to the imaging member.

This and other objects are accomplished by a process which is essentially the same as the prior art process to the point at which the charge injection toner has been applied to the imaging member to create a weak toner image. At this point, rather than fusing the image the imaging member is treated to reduce the effect of an injection inhibiting charge associated with the toner-imaging member interface. After the treating step, the imaging member is uniformly charged, the charge injects into the imaging member and it is toned to create an amplified image.

According to a preferred embodiment, the imaging member containing the weak charge injection toner image is treated by charging it to a polarity opposite that of the electrostatic image. It is then charged to a polarity the same as the electrostatic image. The new charge injects through the toner image into the imaging unit leaving an amplified electrostatic image that could be toned.

According to a second alternative embodiment, the imaging member having a weak electrostatic image which has been toned by charge injection toner is exposed to erasing illumination, preferably from the rear. The imaging member is recharged to a charge of the same polarity as the original weak electrostatic image. The new charge injects through the charge injection toner leaving an amplified electrostatic image that could be toned.

We are not sure why the unfused toner without treatment as described will not readily inject charge, while fusing does inject charge. However, it is our belief that the fusing step thoroughly eliminates all charges associated with the imaging member in both background and image areas while forcing the toner into intimate contact with the imaging member. Apparently, the charge associated with the toner-imaging member interface inhibits injection of charge into the imaging member. If that charge can be eliminated, as it was in fusing, then unfused toner can be used to inject charge and thereby amplify the image. In the preferred embodiments, it is believed that the negative corona and the erase substantially reduce the charge associated with the interface thereby permitting the interface to inject charge when separate charge and toning steps are applied.

According to a further preferred embodiment, the invention works best with a liquid toner as the charge injection toner, because of greater contact with the imaging member. However, amplification can be obtained with dry toners, preferably small particle toners.

A primary advantage associated with the invention is elimination of the fusing step. This not only permits reuse of the photoconductor but eliminates an expensive piece of equipment in carrying out the process.

BRIEF DESCRIPTION OF THE DRAWINGS

In the detailed description of the preferred embodiment of the invention presented below, reference is made to the accompanying drawings, in which.

DISCLOSURE OF THE PREFERRED EMBODIMENT

Figure 1:
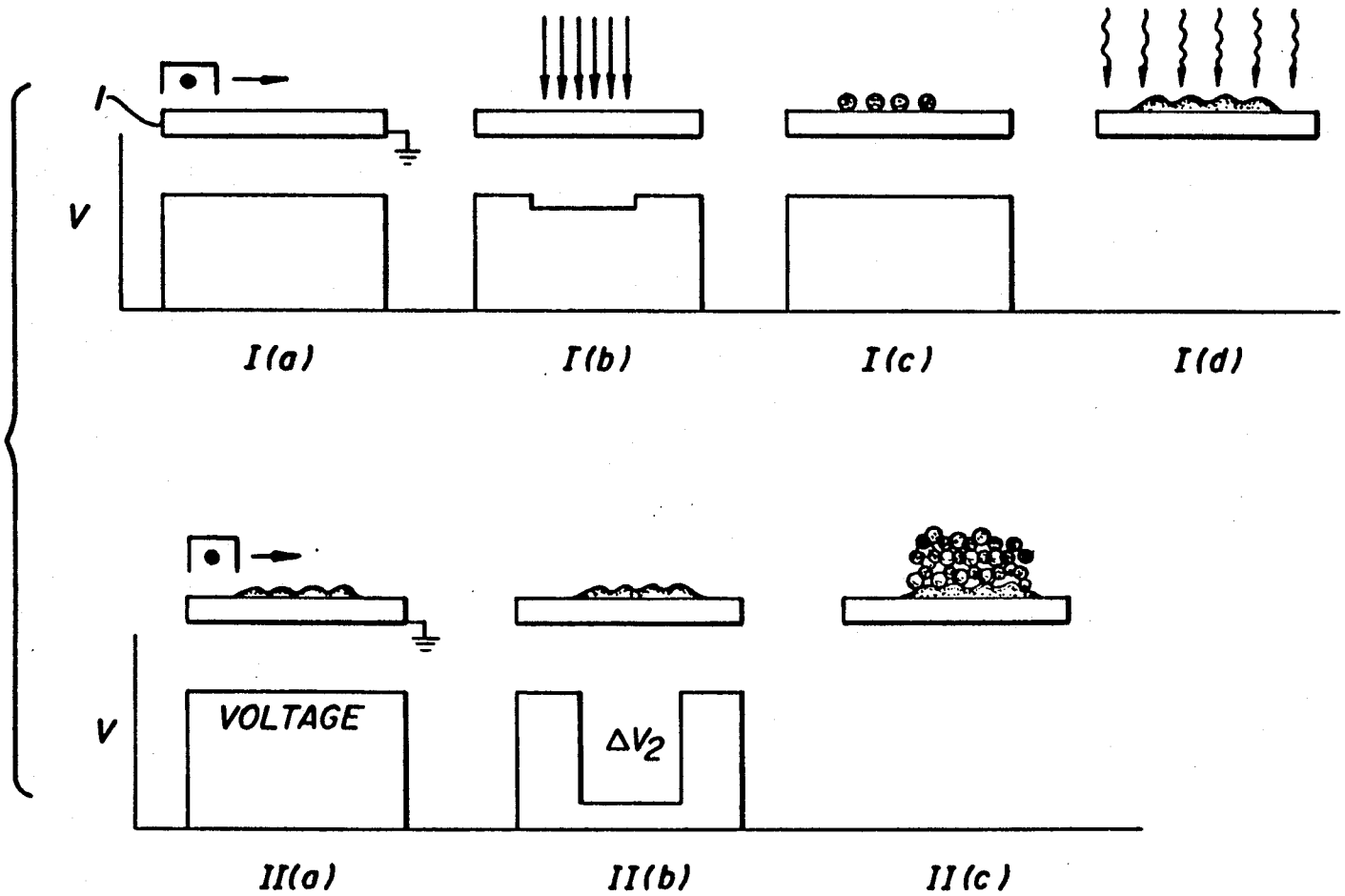
FIG. 1 PRIOR ART
FIG. 1 illustrates the steps of traditional charge injection amplification according to the prior art.

FIG. 1 illustrates charge injection amplification as disclosed in U.S. Pat. No. 4,465,749 and using materials essentially the same as those suggested in that patent. A photoconductive imaging member 1 includes at least a photoconductive layer backed by a conductive backing as in traditional electrophotography. At step I(a), element 1 is charged, for example, to a charge of +600 volts. At I(b) the charged element is imagewise exposed to extremely weak radiation, for example, the amount of light available with an ordinary exposure using ASA 100 photographic film. This extremely low exposure (for electrophotography) dissipates a small amount of charge resulting in areas which, for example, have a potential of +580 volts where exposed. At I(c) this differential in charge is toned by application of a charge injection toner to the imaging member 1 to create a toner image defined by the electrostatic image. The toner can be of either polarity thereby toning either the high potential portions of the imaging member or the partially discharged portions of the imaging member. Because the electrostatic image was weak the toner image necessarily is extremely weak, being barely visible.

At I(d) the weak charge injection toner image is fused to the imaging member 1. The imaging member is now charged again, for example, to a charge of +600 volts as shown in II(a). As shown in II(b), after a short passage of time the charge has injected itself into the imaging member through the toner, creating a large differential in potential between the toned areas and the untoned areas. This differential is then toned as shown in II(c) by applying toner, again of a positive polarity, and resulting in a greatly amplified image. Again, the electrostatic image created in steps II(a) and II(b) could have been toned with a negative polarity toner creating an image in the areas that were not originally exposed in step I(b).

The amplified toner image obtained in step II(c) can be toned in place or transferred to a receiving sheet as in ordinary electrophotography. As disclosed in U.S. Pat. No. 4,465,749, after transfer the charge injection toner image can be reused. That is, it can be used as a xeroprinting master.

When these same steps were tried with either a liquid toner as the charge injection toner in step I(c) or a dry small particle toner but without the fusing step charge injection could not be obtained using steps II(a), II(b) and II(c) in any reasonable time. Thus, it was assumed that fusing was necessary in the process and therefore that, not only was the expense of a fusing step required, it would be inconvenient to reuse the imaging member.

According to the invention, with further treatment of the charge injection toned image obtained by step I(c) we have been able to obtain amplification by charge injection without the fusing step.

EXAMPLE 1

(FIG. 2)

Figure 2:
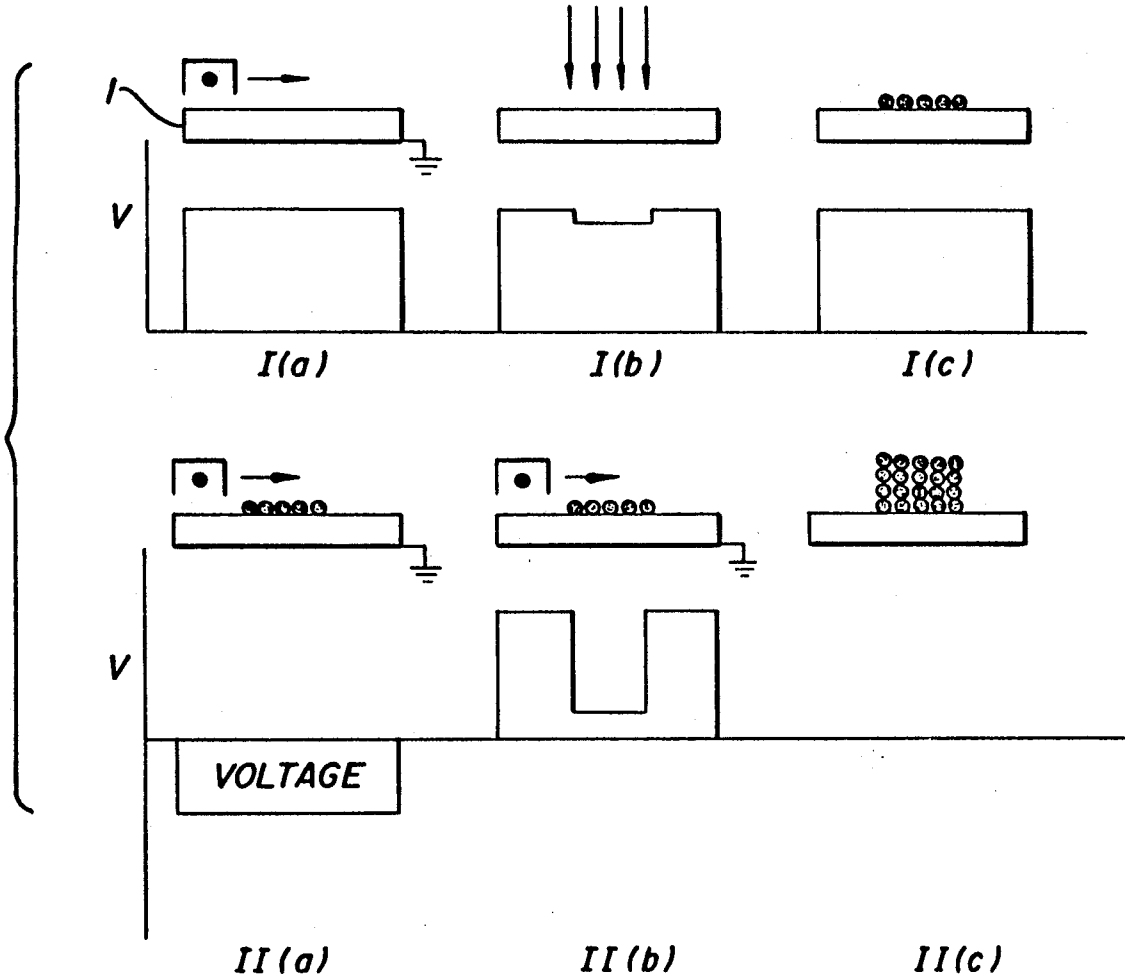
FIGS. 2, 3, and 4 are similar to FIG. 1 but illustrate the steps of charge injection amplification according to embodiments of the invention.

A homogenous bipolar organic photoconductive imaging member 1 was corona charged to a voltage of +600 volts, as shown in FIG. 2, step I(a). The charged imaging member was imagewise exposed to low light with sufficient exposure to create a differential in potential of approximately 30 volts as shown in I(b). A positively charged, carbon black pigmented electrographic liquid developer was applied to the imaging member to develop the exposed areas to a 0.14 neutral density. To this point, the process is essential the same as the prior art shown in FIG. 1. However, the image was not fused.

At step II(a) the imaging member was recharged negatively with a corona grid bias set to −800 volts. As shown at step II(b) the imaging member was recharged to a positive voltage of 800 volts. A charge differential of 300 volts was measured by electrometer between the toned and the untoned areas.

EXAMPLE 2

(FIG. 2)

An imaging member essentially the same as that of Example 1 was charged to a voltage of +800 volts and exposed to low light to a relative exposure providing a difference in potential of 30 volts. It was toned with the same liquid developer as in Example 1 which toner was dried by a vacuum skive to a 0.13 maximum density. The imaging member bearing the unfused toner image was subjected to a corona reversal step with the grid bias set to −200 volts and the imaging member was then recharged to +800 volts. Using an electrometer a voltage difference between the toner and non-toner areas was measured of approximately 240 volts. The same positively charged liquid developer was applied to the imaging member and a good continuous tone final image was obtained with a maximum density equal to 1.07.

EXAMPLE 3

(FIG. 3)

Figure 3:
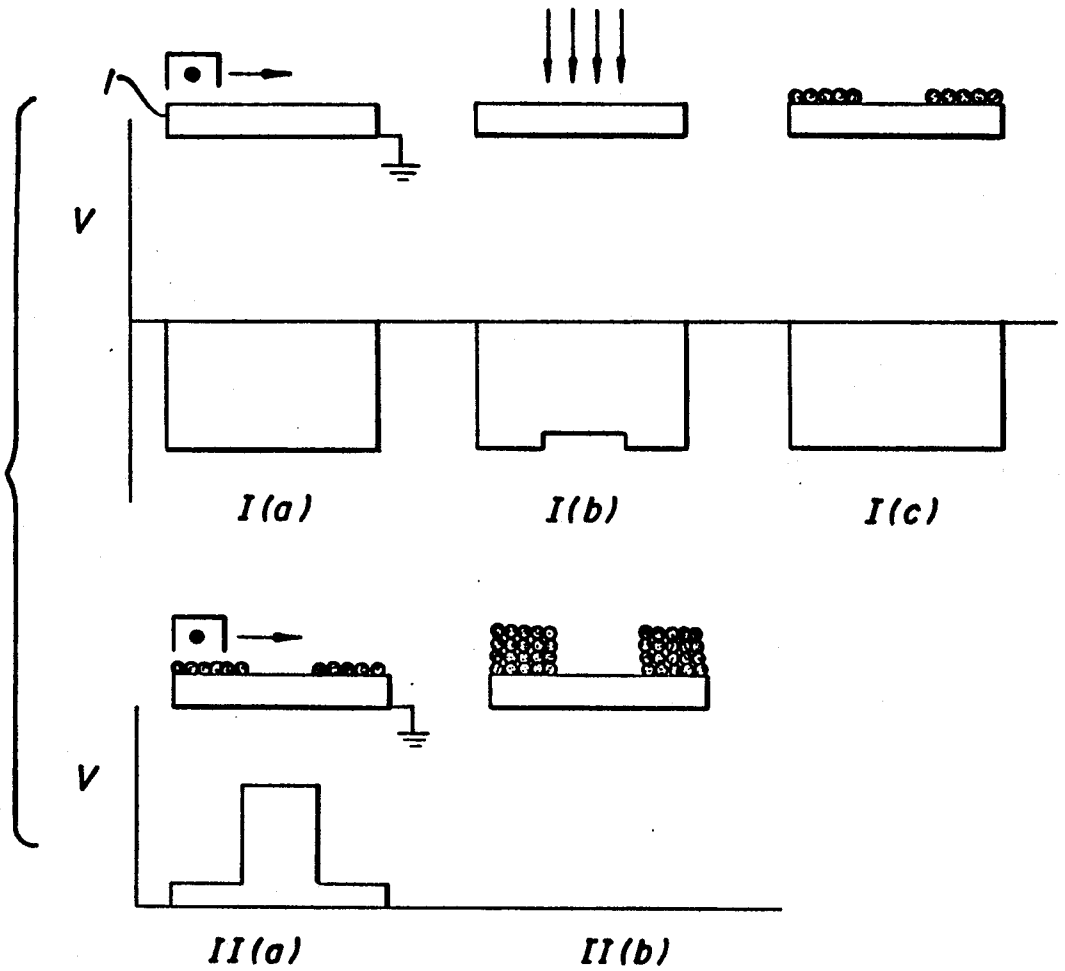

FIG. 3 illustrates a method of forming a positive image of the original exposure rather than the negative image that is formed in Examples 1 and 2. An imaging element identical to that used in Examples 1 and 2 is charged to a negative potential of 700 volts and imagewise exposed to a difference in potential of 40 volts and the same positive toner applied as in Examples 1 and 2 to form a weak toner image having a density of 0.13 in the areas not exposed to the radiation, as shown at I(c) of FIG. 3.

As shown at II(a) the imaging member was recharged positively to a positive potential of 650 volts and the imaging member was redeveloped with the same liquid developer to a maximum density of 0.80.

EXAMPLE 4

(FIG. 2)

An imaging element similar to that used in the preceding examples except that the photoconductive portion is unipolar rather than bipolar was charged to +600 volts, imagewise exposed to obtain a difference in voltage of 32 volts and toned with the same liquid developer as Example 1 to a maximum density of 0.13. A negative charge was applied from a corona having a grid voltage of −800 volts and then the imaging member was recharged to positive 600 volts. A final voltage difference between background and imaging portions was measured at 300 volts. The same liquid developer was applied and produced a continuous tone image having a maximum density of 1.16.

Examples 1, 2 and 4 illustrate that treating the unfused charge injection toner image with a negative corona will permit charge injection of positive charge through the toner even though the toner is not fused. Example 3 starts with a negative charge and then switches to a positive charge. This switch has the same effect. Charge injection is also possible without fusing in that example.

EXAMPLES 5 AND 6

(FIG. 4)

Figure 4:
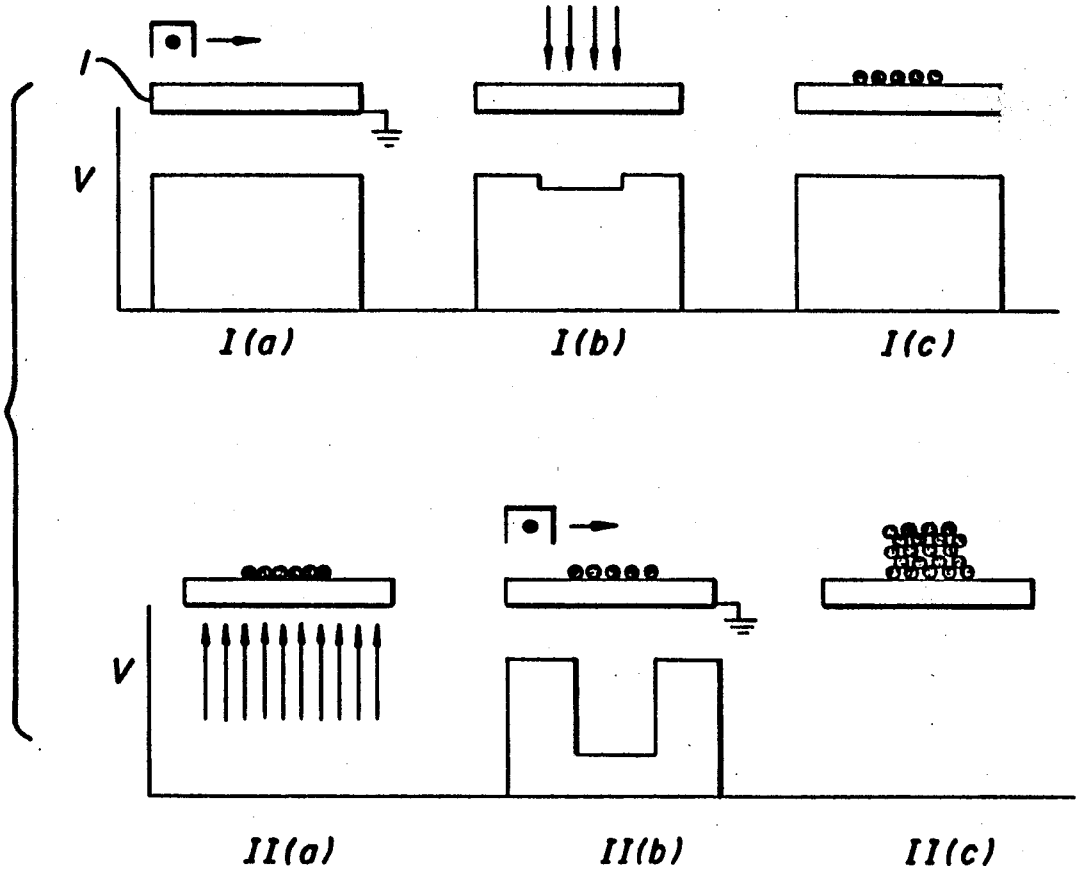

Referring to FIG. 4 an imaging member substantially the same as that used in Example 1 was charged positively to 600 volts, imagewise exposed to produce a difference in voltage of 90 volts and developed with a positively charged carbon black pigmented liquid developer comparable to that in the previous FIGS. to a maximum density between 0.15 and 0.2. The imaging member was vacuum skived to remove excess liquid. After waiting two minutes the imaging member was recharged to +800 volts. Little charge injection was observed with an electrometer.

The imaging member was blanket exposed to room light for between 1 and 2 seconds which included exposure through the base. The imaging member was recharged to positive 800 volts.

A second imaging member was processed as described above with the exception that no blanket exposure to room light was given. The surface potential of both toned areas were measured every few minutes for the next hour.

In the first imaging member it was observed that immediately after recharging there was significant charge injection. For the second imaging member little charge injection was observed during the first hour but after 12 hours the charge injection was similar to that in the first imaging member.

EXAMPLE 7

(FIG. 4)

An imaging member substantially the same as that in Example 4, that is, a homogenous unipolar photoconductive imaging member, was positively charged to 600 volts, imagewise exposed to a drop in voltage of 32 volts and developed to a maximum density of 0.12. The imaging member was exposed to blanket exposure of room light for 1 to 2 seconds and recharged to a positive voltage of 630 volts. After passage of time of 5 minutes a voltage drop was measured of 280 volts. The same liquid developer was applied developing the image to a maximum density of 1.50.

The process works with the same charge injection toners suggested in U.S. Pat. No. 4,465,749. Work done with liquid and dry toners indicates that some charge injection is obtainable with either. However, liquid toners "pancake" a bit more than dry toners and are more intimately associated with the surface of the imaging member. They are therefore preferred in this process.

Example 3 illustrates that fusing was not necessary to get charge injection if the original charge was negative in creating the charge injection toner image. This result is consistent with the theory associated with Examples 1, 2 and 4.

The above examples suggest that the original charge on the imaging member remaining under the charge injection toner for some reason inhibits injection of more charge. In each of the examples, something was done to eliminate that charge before further charge injection takes place.

The invention thus provides an opportunity to get high-quality continuous tone images from very limited exposures comparable to those used in ordinary photography but without the fusing step suggested in U.S. Pat. No. 4,465,749. The absence of the fusing step not only eliminates an expensive station for a continuous process but also permits the imaging element to be reused.

Thus, this process enables use of a permanent imaging member in apparatus making a variety of images from low exposures. Thus, the imaging member is exposed once, toned, the image amplified and the amplified image toned. At this point the amplified toner image can be transferred, the image member cleaned and reused with a new faint image. Alternatively, the original weak charge injection toner image can be reused as a xeroprinting master for several more prints before cleaning. The two toner images can be of different toners. The only requirement is that the first image be of charge injection toner as described in U.S. Pat. No. 4,465,749. In xeroprinting, it is preferable that the second toner also be charge injection toner, so that any untransferred second toner will assist in the next injection process.

The invention has been described in detail with particular reference to a preferred embodiment thereof, but it will be understood that variations and modifications can be effected within the spirit and scope of the invention as described hereinabove and as defined in the appended claims.

We claim:

1. A method of amplifying a weak electrostatic image obtained by uniformly charging a photoconductive imaging member and imagewise exposing the photoconductive imaging member to a low level of radiation, said amplification method comprising:

applying a charge injection toner to said imaging member to create a toner image defined by said electrostatic image, treating said imaging member without fusing said toner image to reduce the charge injection inhibiting effect of charge associated with the interface between the charge injecting toner and the imaging member, and simultaneously with or subsequently to said treating step, charging said imaging member to a positive polarity which positive polarity charge at least partially injects through said toner into said imaging member to create an amplified electrostatic image corresponding to said weak electrostatic image.

2. The method according to claim 1 wherein said treating step is accomplished by charging said imaging member with a negative charge sufficient to reduce said charge inhibiting effect and said step of positively recharging said member is carried out after said step of negative charging.

3. The method according to claim 1 wherein said treating step is accomplished by exposing said imaging member to an erasing illumination sufficient to reduce said charge inhibiting effect and said step of recharging said imaging member with positive charge is carried out after said erase step.

4. The method according to claim 1 wherein said weak electrostatic image is of positive polarity and said step of applying charge injecting toner to said imaging member includes applying positively charge injection toner to said imaging member to create a toner image in the less charged portions of said electrostatic image.

5. The method according to claim 1 wherein said weak electrostatic image is of a negative polarity and said step of applying charge injecting toner includes applying a positively charged charge injection toner to tone the areas of highest potential charge in said electrostatic image, and said step of charging said imaging member to a positive polarity also carries out said treating step.

6. The method according to claim 1 and further including the step of applying a charged toner to said imaging element to create a toner image defined by said amplified electrostatic image.

7. The method according to claim 6 wherein said toner applying steps are carried out by applying the same toner to said imaging member.

8. The method according to claim 1 wherein said step of applying charge injection toner includes applying a liquid charge injection toner to said imaging member.

* * * * *